US006971312B2

(12) United States Patent
Bayer et al.

(10) Patent No.: US 6,971,312 B2
(45) Date of Patent: Dec. 6, 2005

(54) DOCTOR BLADE DEVICE

(75) Inventors: Wolfgang Bayer, Erlingen (DE); Andreas Berchtold, Wessling (DE); Thomas Böck, Neusäss (DE); Robert Konrad, Wiesenbach (DE); Harald Lesti, Aichach (DE); Xaver Bachmeir, Affing-Haunswies (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 611 days.

(21) Appl. No.: 09/875,602

(22) Filed: Jun. 6, 2001

(65) Prior Publication Data

US 2001/0050009 A1 Dec. 13, 2001

(30) Foreign Application Priority Data

Jun. 8, 2000 (DE) ..... 100 28 476

(51) Int. Cl.[7] ..... B41F 35/00
(52) U.S. Cl. ..... 101/423; 101/169
(58) Field of Search ..... 101/169, 167, 101/423, 424, 425, 363–366

(56) References Cited

U.S. PATENT DOCUMENTS

| | | | | | |
|---|---|---|---|---|---|
| 4,462,311 | A | | 7/1984 | Armelin | 101/143 |
| 4,632,030 | A | * | 12/1986 | Laverick | 101/167 |
| 4,790,243 | A | | 12/1988 | Grosshauser | 101/147 |
| 5,097,762 | A | * | 3/1992 | Nakano et al. | 101/169 |
| 5,153,033 | A | * | 10/1992 | Shibata et al. | 427/356 |
| 5,341,741 | A | * | 8/1994 | Schneider et al. | 101/365 |
| 5,850,788 | A | * | 12/1998 | Janser et al. | 101/157 |
| 6,021,297 | A | * | 2/2000 | Campbell et al. | 399/284 |
| 6,145,437 | A | * | 11/2000 | Böck et al. | 101/351.1 |
| 6,155,167 | A | * | 12/2000 | Meyer | 101/157 |
| 6,197,112 | B1 | * | 3/2001 | Stotz et al. | 101/169 |
| 6,305,282 | B1 | * | 10/2001 | Datwyler | 101/169 |

FOREIGN PATENT DOCUMENTS

| | | | |
|---|---|---|---|
| DE | 28 32 172 | | 3/1979 |
| DE | 38 34 932 | | 4/1990 |
| DE | 32 20 701 | | 9/1995 |
| DE | 298 05 201 | | 7/1998 |
| GB | 1381941 | * | 1/1975 |
| JP | 63-84342 | | 6/1988 |

* cited by examiner

*Primary Examiner*—Anthony H. Nguyen
(74) *Attorney, Agent, or Firm*—Cohen, Pontani, Lieberman & Pavane

(57) ABSTRACT

A doctor blade device for the removal of dampening medium from a soft surface of an ink applicator roller in the inking unit of a printing machine, having at least one doctor blade placed against the surface of the roller and having an edge radius in the range of 2 mm to 10 mm.

4 Claims, 1 Drawing Sheet

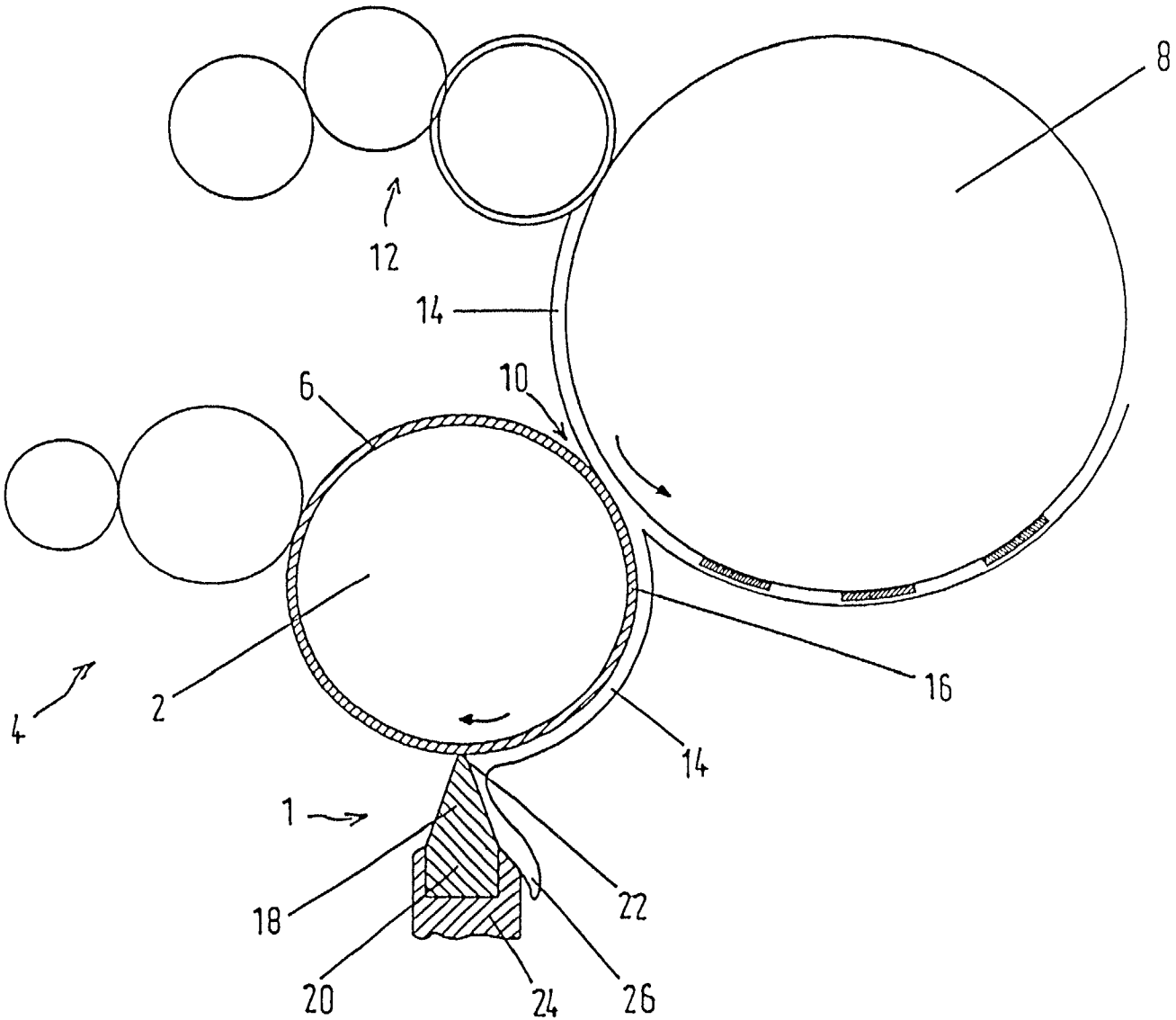
8
16
14
22
26
24
10
14
12
6
1
18
20
2
4

DOCTOR BLADE DEVICE

BACKGROUND OF THE INVENTION

1. Field of the Invention

The invention proceeds from a doctor blade device for the removal of dampening medium from a soft surface of a printing machine roller, in particular from the surface of an ink applicator roller in the inking unit of a printing machine, including at least one doctor blade placed against the surface of the roller.

2. Description of the Related Art

Splitting off dampening medium back into the inking unit of the printing machine presents a problem in wet offset printing, because, in this case, so much water may pass out of the dampening unit via the plate cylinder and the ink applicator roller into the ink supply that the ink becomes over-emulsified. The ink then loses its original rheological properties due to the absorption of too many or too large water droplets.

Continuous printing is then possible only at the expense of serious losses of quality. Although some of the excess water may evaporate on the roller surface, this is possible only to a limited extent, particularly in the case of short inking units with a small number of ink transport rollers from the ink source to the printing forme, with a correspondingly restricted free surface.

DE 298 05 201 U1 discloses an anilox inking unit for a rotary offset printing machine, in which a blowing device is directed at the anilox roller, in order to accelerate the evaporation of excess water by means of compressed air. According to experience, admittedly, this method is successful when the water is in the form of small droplets which are distributed over the surface of the roller and are then reduced in size due to evaporation. By contrast, however, it has been shown that, when water is present over a large area, blowing makes only an insignificant contribution to reducing the water fraction. When the image segments of the plate cylinder transfer ink directly onto paper, there is, furthermore, the problem that small paper fibres may adhere to the surface of the plate cylinder and are then transferred onto the ink applicator roller. Since the dirt particles are a solid phase, they cannot evaporate together with the dampening medium.

SUMMARY OF THE INVENTION

The object of the invention is to provide a doctor blade device which can remove excess water from the soft surface of a printing machine roller in a simple way, without the roller surface being damaged or without an ink layer possibly adhering to it being removed.

This object is achieved by providing the doctor blade with an edge radius in the range of 2 mm to 10 mm.

Damage to the soft surface of the roller is prevented due to the relatively blunt doctor blade edge. If, in addition to the dampening medium, there is also an ink layer on the roller surface, as occurs for example in the case of an ink applicator roller, this ink layer is not stripped off because of the blunt doctor blade, but instead is smoothed in an advantageous way. Essentially only the dampening medium is therefore wiped off and can be disposed of more simply than a dampening-medium/ink emulsion.

Due to the relatively large radius of the doctor blade edge, the desired wiping-off of dampening medium commences even under low throw-on forces, and this has a beneficial effect on the service life of the doctor blade and of the roller. An even larger radius than that specified would lead to an undesirable build-up of dampening medium at the doctor blade edge, whilst a smaller radius would wipe off the ink layer.

In contrast to the blowing method, in which the dampening medium itself evaporates, but not dirt particles dissolved in the dampening medium, the dirt particles are transported away, together with the dampening medium, by the doctor blade according to the invention. Furthermore, as compared with the blowing method, even larger quantities of dampening medium can be removed.

According to measures particularly to be preferred, a doctor blade edge of the doctor blade is pressed into the soft surface of the printing machine roller to a depth of 0 mm to 0.2 mm, preferably 0.1 mm. This results in a relatively low pressing force, along with a beneficial effect on the service life of the doctor blade and the roller.

In a development of the invention, the doctor blade is designed as an exchangeable strip held by a doctor-blade bearing block. This results in a simple construction which is easy to operate. According to a further measure, the doctor blade is provided with a sliding coating in order further to increase its service life.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The single FIGURE shows a highly diagrammatic cross-sectional view of a printer unit with a doctor blade device according to the invention in a preferred embodiment which is placed against an ink applicator roller.

DETAILED DESCRIPTION OF THE PRESENTLY PREFERRED EMBODIMENTS

The doctor blade device 1 according to the invention is placed against ink applicator roller 2 in the inking unit 4 of a printer unit, the surface 6 of the roller being soft. The ink applicator roller 2 is in contact with a plate cylinder 8 via a nip 10, the plate cylinder 8 being fed by a dampening unit 12 with dampening medium or dampening water 14 which settles on the plate cylinder 8 and is finally transferred from there onto the ink applicator roller 2. The ink delivered by the inking unit 4 adheres to the surface 6 of the roller 2 in the form of an ink layer 16.

The dampening medium 14 transferred from the plate cylinder 8 settles on the ink layer 16 mainly from outside, so that, as seen in the direction of rotation of the ink applicator roller 2 and of the plate cylinder 8, layers, separate from one another, of ink 16, illustrated by hatching, and of dampening medium 14, illustrated by a border, are formed on the surface 6 of the ink applicator roller 2 downstream of the nip 10.

In order to remove excess dampening medium 14 from the surface 6 of the ink applicator roller 2, a doctor blade 18 of the doctor blade device 1 is arranged directly downstream of the nip 10, as seen in the direction of rotation of the ink applicator roller 2 and of the plate cylinder 8.

The doctor blade 18 is designed as a strip which runs parallel to the longitudinal direction of the ink applicator roller 2 and has a wide base 20 and of an approximately circularly arcuate doctor blade edge 22 placed against the surface 6 of the ink applicator roller 2. The doctor blade edge 22 has a doctor blade edge radius in the range of 2 mm to 10 mm, preferably 4 mm to 8 mm. The base 20 of the strip is held exchangeably in a doctor-blade bearing block 24 which co-operates by means of a placement device, not illustrated in the figure for reasons of scale, in order to place the doctor blade 18 against the surface 6 of the ink applicator roller 2.

The doctor blade 18 is placed without pressure or with only slight force, that is to say the doctor blade edge 22 is pressed into the soft surface 6 of the ink applicator roller 2 to a depth of 0 mm to 0.2 mm, preferably 0.1 mm. Due to the relatively large radius of the doctor blade edge and to the relatively low placement force, the dampening medium 14 is wiped off from the surface 6 of the ink applicator roller 2, but not the ink layer 16 which is merely smoothed by means of the placement pressure of the doctor blade edge 22. The wiped-off dampening medium 26 can flow away along a lateral doctor-blade surface and is collected, for example, in a container.

In order to increase the service life of the doctor blade 18, at least the doctor blade edge 22 is provided with a sliding coating.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A printing arrangement comprising:

a plate cylinder;

an ink applicator roller having a soft surface for carrying a layer of ink and a layer of dampening medium, said applicator roller contacting said plate cylinder and picking up dampening medium at a nip; and a doctor blade having an edge contacting said soft surface of said ink applicator roller downstream of said nip, said doctor blade being configured to remove said layer of dampening medium from said soft surface without removing a residual layer of ink adhered to said soft surface, said edge having an edge radius in the range of 2 mm to 10 mm.

2. The printing arrangement of claim 1, wherein said edge of said doctor blade is pressed into the soft surface of the ink applicator roller to a depth of 0 mm to 0.2 mm.

3. The printing arrangement of claim 1, wherein said edge of said doctor blade is pressed into the soft surface of the ink applicator roller to a depth of 0.1 mm to 0.2 mm.

4. The printing arrangement of claim 1, further comprising a dampening unit for applying said dampening medium to said plate cylinder upstream of and before said plate cylinder reaches said nip, and an inking unit for applying ink to said ink applicator roller before said roller reaches the nip.

* * * * *